United States Patent [19]

Ito

[11] 3,942,956

[45] Mar. 9, 1976

[54] PROCESS FOR ELIMINATING NITROGENOUS INGREDIENTS FROM SOLID FUEL

[75] Inventor: Shozo Ito, Ichikawa, Japan

[73] Assignee: Mifuji Iron Works, Ltd., Tokyo, Japan

[22] Filed: Feb. 6, 1975

[21] Appl. No.: 547,577

[30] Foreign Application Priority Data

July 12, 1974 Japan ..... 49-079949

[52] U.S. Cl. ..... 44/1 R; 201/17; 423/461

[51] Int. Cl.[2].. C10L 9/00; C10L 9/02; C10B 57/00; C01B 31/02

[58] Field of Search ..... 44/1 R; 201/17; 423/461, 423/352

[56] References Cited

UNITED STATES PATENTS

| | | | |
|---|---|---|---|
| 2,740,693 | 4/1956 | Pomykala | 44/1 R |
| 2,872,384 | 2/1959 | Nelson et al. | 201/17 X |
| 2,878,163 | 3/1959 | Hutchings | 201/17 X |
| 3,007,849 | 11/1961 | Nelson et al. | 201/17 X |
| 3,600,130 | 8/1971 | Aldridge et al. | 423/461 |

*Primary Examiner*—Carl F. Dees

[57] ABSTRACT

A nitrogenous ingredient is eliminated from solid fuel, for example, coal, by treating in a treating chamber, the coal with a treating gas having a predetermined temperature and composition at a temperature of 650° to 1200°C, the treating gas being prepared by uniformly mixing, in a conditioning chamber located upstream from the treating chamber, a predetermined amount of steam or water and hydrogen gas or a mixture gas containing at least 30% by volume of hydrogen gas together with an inert burnt gas containing at most 2% by volume of oxygen gas.

10 Claims, 3 Drawing Figures

PROCESS FOR ELIMINATING NITROGENOUS INGREDIENTS FROM SOLID FUEL

The present invention relates to a process for eliminating a nitrogenous ingredient from solid fuel.

It is well-known that combustion in the atmosphere of solid fuel containing a nitrogenous ingredient therein results in generation of nitrogen oxides (NOx) which cause pollution of the atmospheric air. Ordinary coal and petroleum coke, for example, have about 0.2 to 2.0% and about 0.1 to 1.0% by weight of nitrogen content, respectively. Accordingly, in order to prevent the generation of nitrogen oxides by the combustion of the solid fuel, it is desirable that the solid fuel be treated prior to the combustion so as to completely eliminate or reduce the content of nitrogen in the solid fuel to at most 0.1% by weight.

It is still not clear in what manner the nitrogenous ingredient is contained in the solid fuel, although, it is known that, for example, nitrogen atoms in coke directly bond to carbon atoms in the coke so as to form the compounds of the formula CxNy. These compounds are relatively stable under normal conditions. However, it is also known that the compounds of the formula CxNy tend to be converted into ammonia upon exposure to heat at a high temperature for a long period of time. Accordingly, there have been several attempts to eliminate the nitrogenous ingredient from the solid fuel by utilizing the above-mentioned conversion of the nitrogen compound. However, these attempts have not yet met with success with regard to practical use.

In one previous method, the solid fuel is charged in a treating furnace and is externally heated in said furnace while the air flow into the furnace is shut off. According to this method, the solid fuel is indirectly heated to a temperature of 800° to 2000°C. However, this method has the disadvantages of too high a temperature and too long a treatment time as well as difficulty in controlling the temperature of the solid fuel in the furnace. Further, this method has failed in completely eliminating the nitrogenous ingredients from the solid fuel. For example, coal having 1.67% by weight of nitrogen content was charged into a fixed-bed-type treating furnace, and externally heated at a temperature of 1800° to 1900°C for 2.5 hours. The resultant solid fuel still had about 0.21% by weight of nitrogen content. The amount of the nitrogen eliminated from the solid fuel was only about 87% based on the initial nitrogen content. When the above-stated operations are carried out at a temperature of 1380°C for a period of 34 hours, the amount of eliminated nitrogen was about 80% based on the initial nitrogen content. In addition to this low elimination of the nitrogen content, this method requires a very expensive external heating furnace which has a very high resistance to heat. In spite of this, however, the furnace is constantly subjected to erosion during high temperature operation. The above-mentioned problems make this method disadvantageous, economically. Accordingly, even though the principle for eliminating the nitrogen content from the solid fuel has been already known, the method for realizing said principle has not yet been successful in practical use.

The object of the present invention is provide a process for eliminating nitrogen content from solid fuels at a relatively low temperature within a relatively short time, and which is economically highly efficient.

The above object is accomplished by the process of the present invention, which comprises the steps of:

1. preparing a substantially inert burnt gas containing at most 2% of volume of free oxygen by completely burning a mixture of a fuel and air or oxygen gas in a combustion chamber;
2. feeding said burnt gas into a conditioning chamber directly connected to said combustion chamber at a predetermined feed rate;
3. simultaneously feeding steam or water and hydrogen gas or other gas containing therein at least 30% by volume of free hydrogen gas into said conditioning chamber at predetermined feed rates;
4. uniformly mixing said burnt gas said steam or water and said hydrogen gas or hydrogen gas-containing gas within said conditioning chamber to provide a treating gas for eliminating said nitrogen content, said treating gas having a predetermined temperature and composition;
5. feeding a solid fuel into a treating chamber;
6. feeding said treating gas into said treating chamber, and,
7. treating said solid fuel with said treating gas at a temperature of 650° to 1200°C.

The feature and constitution of the process of the present invention will be more clearly understood by reading the following description with reference to the accompanying drawings, in which.

Figure 1:
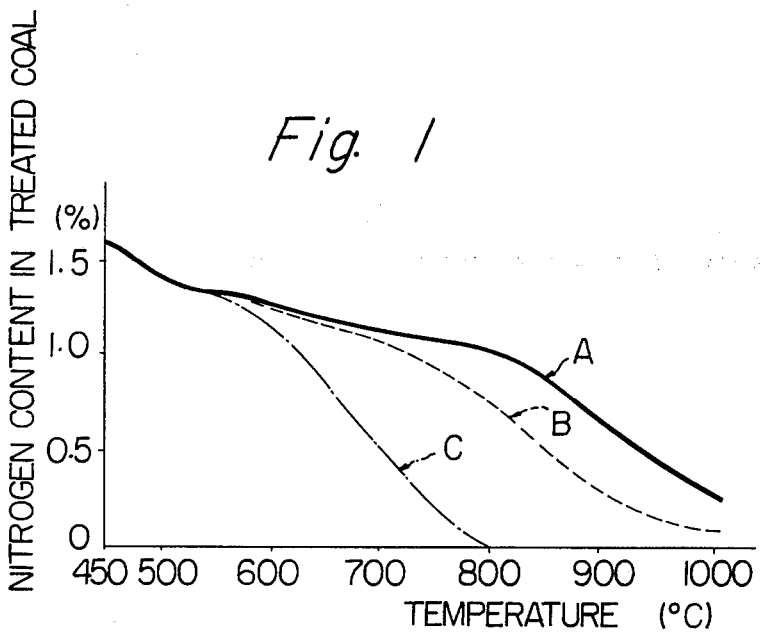
FIG. 1 is a diagram showing the relationships between the heating temperature for coal in °C and nitrogen content in % in the coal according to the process of the present invention (Curve C) and according to other processes (Curves A and B)

The fuel for the burnt gas may be optionally elected from ordinary gas fuels, for example, oil gas, natural gas, propane gas, town gas, water gas or coke over gas; ordinary liquid fuels, for example, light oil, heavy oil or liquefied cool oil; or finely divided solid fuels, for example, coal, coke and charcoal, wood or waste agricultural products, unless the resultant burnt gas would affect the elimination of nitrogen content from the solid fuel.

The fuel is uniformly mixed with air or oxygen gas in a mixing chamber in such a proportion that the resultant burnt gas contains at most 2% by volume of free oxygen gas and is, therefore, substantially inert to the solid fuel to be treated. The fuel mixture is fed into a combustion chamber and is completely burnt therein. The combustion chamber must have a large inside volume, big enough to completely burn the fuel mixture therewithin. The resultant burnt gas is a substantially inert high temperature gas containing therein at most 2% by volume of free oxygen.

The burnt gas thus prepared is fed into a conditioning chamber directly connected to the combustion chamber. It is preferable that the conditioning chamber have an inside volume of 1½ times or more, more preferably, 1½ to 4 times the inside volume of the combustion chamber. At the same time the burnt gas is being fed into the combustion chamber, steam or water and hydrogen gas or the hydrogen-containing gas is being introduced into the conditioning chamber and is uniformly admixed with the burnt gas in order to prepare a treating gas having a predetermined temperature and composition. In the preparation of the treating gas, the proportion of the component gases is determined in response to the temperature and pressure of the burnt gas, steam or water and hydrogen gas or the hydrogen-containing gas, and to the composition of the burnt gas and the hydrogen-containing gas. Generally, treating gas pertinent for the process of the present invention has a preferable temperature of 650° to 1200°C, more preferably 650° to 900°C, and preferably contains 0.02 to 0.2 kg, more preferably, 0.05 to 0.10 kg of steam per 1 kg of the solid fuel and 0.05 to 0.5 $Nm^3$, more preferably, 0.06 to 0.25 $Nm^3$ of hydrogen per 1 kg of the solid fuel to be treated.

The steam to be introduced into the conditioning chamber may be ordinary steam having a temperature of approximately 107°C or superheated high presssure steam having a temperature of 120°C or higher. The steam may be replaced by water or hot water which is vaporized immediately when introduced into the conditioning chamber.

The hydrogen gas to be introduced into the conditioning chamber may be industrially pure hydrogen gas or may be replaced by the mixture gas containing at least 30% by volume of hydrogen, for example, a mixture gas generated by catalytically cracking petroleum hydrocarbons or coke oven gas. These hydrogen-containing gases have, for example, compositions as indicated in Table 1.

Table 1

| Gas<br>Component (% by volume) | Catalytically crached petroleum hydrocarbon gas | Coke oven gas |
|---|---|---|
| $CO_2$ | 5.7 | 2.0 |
| hydrocarbons(CmHn) | 10.3 | 2.6 |
| $O_2$ | 0.1 | 0.4 |
| CO | 15.0 | 7.4 |
| $H_2$ | 53.1 | 54.0 |
| $CH_4$ | 7.4 | 28.0 |
| N | 8.4 | 5.6 |

The solid fuel usable for the process of the present invention may be selected from various types of coals having a nitrogen content, that is, peat, brown coal, ordinary coal, smokeless coal, or bituminous coal, coke, petroleum coke, charcoal or carbon produced from the above-mentioned solid fuels. The solid fuel may be in the form of powder, lump or grain. However, in order to promote the elimination of the nitrogen content from the solid fuel by enlarging the content area of the solid fuel with the treating gas, it is preferable that the solid fuel be in the form of fine particles having a 5 to 100 mesh size.

In the treating chamber, the solid fuel may form any type of bed such as a fixed bed a fluidized bed or a moving bed. However, in order to accelerate the elimination rate of the nitrogen content from the solid fuel, it is preferable that the finely divided solid fuel forms a fluidized bed in the treating chamber. That is, it is preferable that the solid fuel be treated in a fluidized bed-type furnace with the treating gas of the present invention.

The solid fuel is treated with treating gas, which is usually under normal pressure, in the treating chamber. The nitrogen content in the solid fuel is converted into ammonia by the treatment and the ammonia thus generated is vaporized and separated from the solid fuel.

The effect of the process of the present invention will be clarified in detail by referring to FIG. 1 of the accompanying drawings.

In FIG. 1, Curve A shows a relationship between the heating temperature for coal having a nitrogen content of 1.67% and the remaining nitrogen content in the coal when the coal has been treated, in a fluidized bed furnace, with an inert burnt gas having a temperature of 550°to 1000°C for 20 to 30 minutes, Curve B shows a relationship between the heating temperature for the same coal as in Curve A and the remaining nitrogen content in the coal treated with a treating gas, consisting of the same inert burnt gas as in Curve A, and steam in an amount of 0.3 kg per 1 kg of the coal to be treated. Curve C shows a relationship of the heating temperature of the same coal as in Curve A and the remaining nitrogen content in the coal which has been treated with a treating gas, consisting of the same inert burnt gas in Curve A, and 0.05 kg of steam and 0.08 $Nm^3$ of hydrogen gas per 1 kg of the coal to be treated. According to Curve A, the coal treated with treating gas consisting of only the inert burnt gas has a relatively high nitrogen content larger than 0.35% even when heated at a temperature of 1000°C. Also, Curve B indicates that the coal treated with treating gas consisting of the inert burnt gas and steam still has a relatively high nitrogen content of 0.15% or higher even when heated at 1000°C. However, as indicated in Curve C, when the coal is treated in accordance with the process of the present invention with treating gas consisting of the inert burnt gas, steam and hydrogen gas, the remaining nitrogen content of the treated coal is relatively low, that is, 0.1% or less, even if the treating is carried out at a relatively low temperature of 800°C. FIG. 1 definitely proves that the treating gas consisting of a mixture of the inert burnt gas with both steam and hydrogen gas is very effective for eliminating the nitrogen content from solid fuel.

Figure 2:
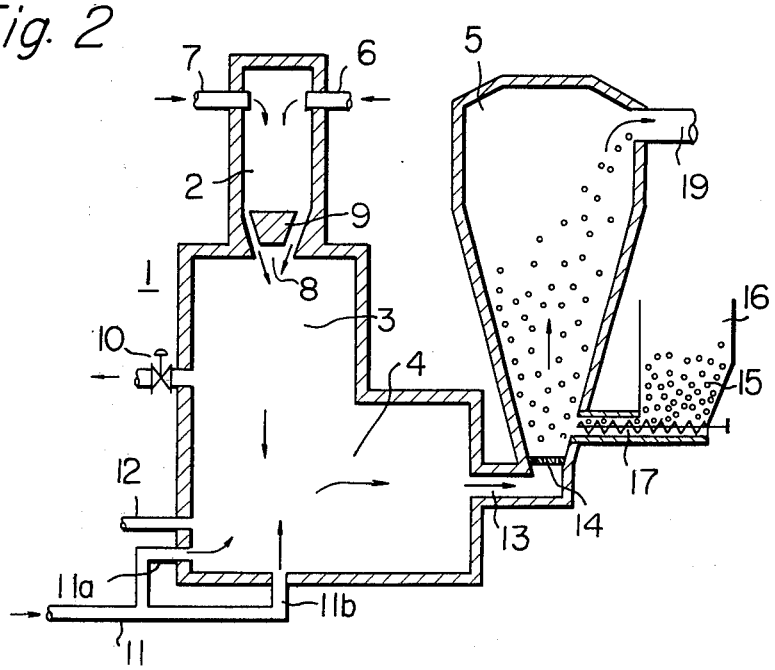
FIG. 2 is an explanatory cross-sectional view of an embodiment of the apparatus for effecting the process of the present invention.
Figure 3:
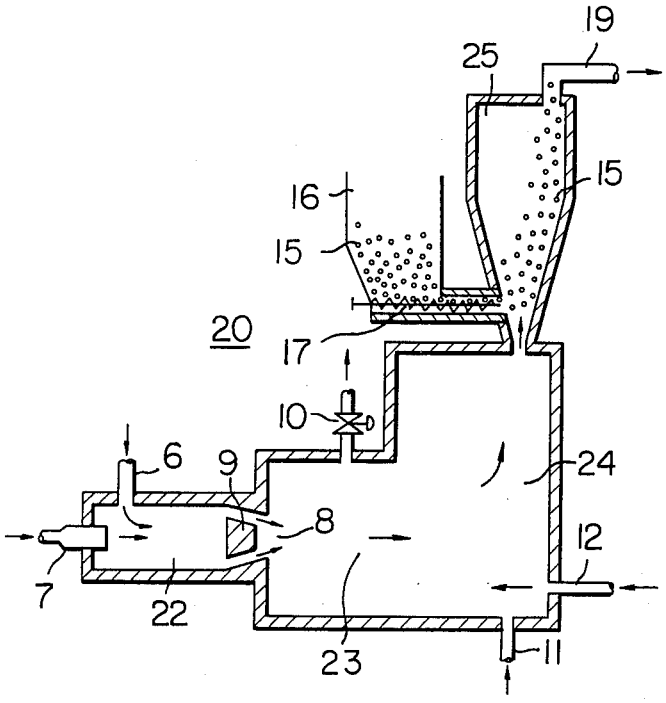
FIG. 3 is an explanatory cross-sectional view of the other embodiment of the apparatus for performing the process of the present invention.

The process of the present invention can be carried out by using the apparatus as shown, for example, in FIGS. 2 and 3. In FIG. 2, an apparatus 1 for eliminating nitrogenous ingredients from solid fuel is provided with a mixing chamber 2, a combustion chamber 3, a conditioning chamber 4 and a fluidized bed-type treating chamber 5. The mixing chamber 1 is provided with a conduit 6 for feeding a fuel and a conduit 7 for supplying air or oxygen gas thereinto. The fuel supplied through the conduit 6 is uniformly mixed with air or oxygen gas supplied through the conduit 7 into the mixing chamber 2. The mixing chamber 2 has therein a cylindrical internal space having an inside periphery which extends in the same direction as that of the flow of the gas mixture. An exit end of the mixing chamber 2 forms on opening 8 through which the gas mixture is ejected from the mixing chamber 2 into the combustion chamber 3. The ejecting opening 8 may be provided with a device for controlling the flow of the gas mixture therethrough. The flow control device can regulate the flow rate, flow velocity and flow direction of the gas mixture so as to attain the desired levels. An example of the flow control device is shown in FIG. 2. That is, the exit end of the mixing chamber 2 has a circular cone shape converging toward the combustion chamber 3. In the circular cone-shaped space, a flow regulator 9 is located. The flow regulator 9 also has a circular cone shape converging toward the combustion chamber 3 and is movable so as to adjust the effective cross sectional area of the ejecting opening 8. By adjusting the position of the flow regulator 9, the gas mixture's flow velocity, flow rate and flow direction can be regulated and can be diffused uniformly into the combustion chamber 3. When this happens, the gas mixture is ignited and is uniformly and completely burnt therewithin. The combustion chamber 3 is provided with a cylindrical internal space having an inside periphery which extends along the direction of the flow of the burnt gas in the internal space. In order to completely burn the gas mixture in the combustion chamber 3, it is preferable that the inside diameter of the combustion chamber 3 satisfies the following relationship:

$$dc \geqq 1\frac{1}{4}dM \qquad (1)$$

wherein dc represents the inside diameter of the internal space of the combustion chamber 3 and dM represents the inside diameter of the ejecting opening 8. A dc smaller than 1¼ dM may result in the imperfect combustion of the gas mixture. The burnt gas thus prepared has a high temperature and contains therein at most 2% by volume of free oxygen. The burnt gas is introduced from combustion chamber 3 into conditioning chamber 4. If it is desired, a portion of the burnt gas may be withdrawn through a discharge conduit 10. The conditioning chamber 4 is provided with branch conduits 11*a* and 11*b* connected to a main conduit 11 for feeding steam or water. The conditioning chamber further has a conduit 12 for feeding hydrogen gas or hydrogen-containing gas into it. The flow rates of the steam or water and the hydrogen gas or hydrogen-containing gas to be mixed with the burnt gas, are determined in response to the temperature, pressure and composition of the treating gas prepared within the conditioning chamber 4.

In order to uniformly mix the burnt gas and steam or water and, hydrogen gas or hydrogen-containing gas, and to prepare a uniform treating gas, it is preferable that the conditioning chamber have an internal space satisfying the following relationship:

$$1\frac{1}{2}Vc \leqq V_A$$

wherein V*c* represents the volume of the internal space of the conditioning chamber. A $V_A$ smaller than 1½ V*c* cause non-uniform mixing of the burnt gas and steam and hydrogen gas.

The treating gas thus uniformly prepared is supplied from the conditioning chamber 4 into the treating chamber 5 through a supply path 13. The treating chamber 5 may have a slit or grid 14 which is optional, and which can be located at the inlet end of chamber 5. The finely divided solid fuel 15 is fed from a hopper 16 into the entrance of the treating chamber 5 by means of a screw conveyer 17. The solid fuel 15 thus fed is fluidized by a stream of the treating gas and the nitrogenous ingredient in the solid fuel is converted into ammonia by the action of the treating gas.

The generated ammonia gas is discharged together with the solid fuel fluidized in the treating gas from the treating chamber through a discharge conduit 19. The solid fuel thus treated is separated from the mixture of ammonia gas and the treating gas by a conventional separating apparatus, for example, a cyclone dust collector (shown in neither FIG. 2 nor FIG. 3). The gas mixture is fed into an apparatus (shown in neither FIG. 2 nor FIG. 3) for removing ammonia, for example, an ammonia absorbing column or thermally decomposing column for ammonia. The harmless waste gas is discharged into the atmosphere.

The process of the present invention can be effected by using the apparatus shown in FIG. 3. Referring to FIG. 3, the apparatus 20 is provided with a mixing chamber 22, a combustion chamber 23, a conditioning chamber 24 and a treating chamber 25. The mixing chamber 22 and the combustion chamber 23 in FIG. 3 have the same structure as those in FIG. 2, except that the cylindrical internal spaces of the mixing chamber 22 and the combustion chamber 23 in FIG. 3 extend horizontally whereas those in FIG. 2 extend vertically. The conditioning chamber 24 has a conduit 11 for feeding steam or water and a conduit 12 for feeding hydrogen gas or the hydrogen-containing gas into said conditioning chamber.

The solid fuel treated in accordance with the process of the present invention contains no substantial amount of the nitrogenous ingredient, that is, more than 0.1% by weight.

The features and advantages of the process of the present invention are further illustrated by the following example, which is not intended to limit the scope of the present invention.

EXAMPLE

A type of the apparatus shown in FIG. 2 was used for eliminating the nitrogenous ingredient from coal. The coal was a non-caking kind having a nitrogen content of 1.67% by weight and was reduced into a 15 to 80 mesh size powder.

A fuel consisting of a saturated hydrocarbon gas ($CH_4 + C_2H_6$: about 91%, $H_2$: about 6.5% and CO: about 2.5% by volume) was preheated to a temperature of 150°C and was then fed into a mixing chamber at a feed rate of 40 $Nm^3$/hour. Air was separately preheated to a temperature of 180°C and was then fed into the mixing chamber at a feed rate of 400 $Nm^3$/hour. The air and fuel gas were uniformly mixed in the mixing chamber. The fuel mixture gas was ejected into a combustion chamber having an inside diameter (*dc*) of 40 cm and an inside volume (V*c*) of 0.07$m^3$ through an ejecting opening having an inside diameter (*d*M) of 1.0 cm, and was ignited so as to completely burn the fuel mixture gas. The resultant burnt gas contained therein a very small amount, 0.2% volume, of free oxygen gas and, therefore, was substantially inert. The burnt gas was then introduced into the conditioning chamber having an inside volume of 0.15 $m^3$. Steam at a temperature of 107°C was separately introduced into the conditioning chamber at a flow rate of 4 kg/hour and, simultaneously, hydrogen gas at room temperature was fed thereinto at a flow rate of 7 $Nm^3$/hour. The burnt gas was uniformly mixed with the steam and hydrogen gas within the conditioning chamber. The resultant treating gas had a temperature of 1000°C, and was introduced into the treating chamber.

The non-caking coal was supplied into the treating chamber at a supply rate of 100 kg/hour, and fluidized and treated by the treating gas under normal pressure.

The nitrogen-eliminated coal and the generated ammonia were dicharged together with the treating gas from the treating chamber and forwarded to a cyclone dust collector in order to separate the nitrogen-eliminated coal from the gas mixture. The gas mixture was fed into an ammonia absorbing column wherein ammonia was absorbed by activated carbon.

The nitrogen-eliminated coal had a very small nitrogen content of 0.02%. That is, about 98.2% of nitrogen based on the initial content of nitrogen in the coal was eliminated from the coal by the process of the example.

What we claim is:

1. A process for continuously eliminating a nitrogenous ingredient from solid fuels, comprising the steps of:

1. preparing a substantially inert burnt gas containing at most 2% by volume of free oxygen by completely a mixture of a fuel and air or oxygen gas in a combustion chamber;
2. feeding said burnt gas into a conditioning chamber directly connected to said combustion chamber at a predetermined feed rate,
3. simultaneously feeding steam or water and hydrogen gas or other gas containing therein at least 30% volume of free hydrogen gas into said conditioning chamber at predetermined feed rates;
4. uniformly mixing said burnt gas and said steam or water and said hydrogen gas or hydrogen gas-containing gas within said conditioning chamber to provide a treating gas for eliminating said nitrogenous ingredient, said treating gas having a predetermined temperature and composition;
5. feeding a solid fuel into a treating chamber;

6. feeding said treating gas into said treating chamber, and;
7. treating said solid fuel with said treating gas at a temperature of 650° to 1200°C.

2. A process as set forth in claim 1, wherein said treating gas has a temperature of 650° to 1200°C.

3. A process as set forth in claim 2, wherein said treating gas temperature is between 650° to 900°C.

4. A process as set forth in claim 3, wherein said treating gas contains 0.02 to 0.2 kg of steam and 0.05 to 0.5 $Nm^3$ of free hydrogen gas per 1 kg of said solid fuel to be treated with said treating gas.

5. A process as set forth in claim 4, wherein the contents of steam and free hydrogen gas in said treating gas are 0.03 to 0.10 kg and 0.06 to 0.25 $Nm^3$ per 1 kg of said solid fuel, respectively.

6. A process as set forth in claim 1, wherein said hydrogen-gas-containing gas is either a gas generated by catalytically cracking petroleum hydrocarbons or coke oven gas.

7. A process as set forth in claim 1, wherein said solid fuel is selected from the group consisting of coal, coke, petroleum coke, or carbon materials produced from the above-mentioned materials.

8. A process as set forth in claim 1, wherein said solid fuel has a 5 to 100 mesh size.

9. A process as set forth in claim 1, wherein said treating chamber is a fluidizing bed-type furnace.

10. A process as set forth in claim 1, wherein said treating of said solid fuel is carried out under normal pressure.

* * * * *